US011577943B2

(12) United States Patent
Koertge et al.

(10) Patent No.: US 11,577,943 B2
(45) Date of Patent: Feb. 14, 2023

(54) CRANE WITH AN ERECTING TRESTLE

(71) Applicant: Liebherr-MCCtec Rostock GmbH, Rostock (DE)

(72) Inventors: Stephan Koertge, Bludenz (AT); Fischer Helmut, Bludesch (AT); Christian Matt, Feldkirch (AT)

(73) Assignee: Liebherr-MCCtec Rostock GmbH, Rostock (DE)

( * ) Notice: Subject to any disclaimer, the term of this patent is extended or adjusted under 35 U.S.C. 154(b) by 100 days.

(21) Appl. No.: 16/953,231

(22) Filed: Nov. 19, 2020

(65) Prior Publication Data

US 2021/0155462 A1 May 27, 2021

(30) Foreign Application Priority Data

Nov. 22, 2019 (DE) ..... 20 2019 106 512.5

(51) Int. Cl.
*B66C 23/82* (2006.01)
*B66C 23/52* (2006.01)

(52) U.S. Cl.
CPC ..... *B66C 23/823* (2013.01); *B66C 23/52* (2013.01)

(58) Field of Classification Search
CPC ..... B66C 23/24; B66C 23/52; B66C 23/82; B66C 23/823
See application file for complete search history.

(56) References Cited

U.S. PATENT DOCUMENTS

| | | | | |
|---|---|---|---|---|
| 4,635,803 | A * | 1/1987 | Foster | B66C 23/52 212/262 |
| 2014/0175039 | A1* | 6/2014 | Yamamoto | B66C 23/92 212/294 |
| 2014/0175040 | A1* | 6/2014 | Yamamoto | B66C 23/82 212/299 |
| 2020/0039800 | A1* | 2/2020 | Murayama | B66C 23/823 |
| 2020/0216294 | A1* | 7/2020 | Stoof | B66C 23/70 |
| 2022/0162045 | A1* | 5/2022 | Van Veluw | B66C 13/02 |

FOREIGN PATENT DOCUMENTS

| | | | | |
|---|---|---|---|---|
| DE | 7907258 | U1 | 8/1979 | |
| DE | 202015008775 | U1 | 3/2017 | |
| EP | 0153450 | A2 | 9/1985 | |
| EP | 2275378 | A1 * | 1/2011 | B66C 23/36 |
| JP | 2018002384 | A * | 1/2018 | B66C 23/06 |
| WO | WO-2020204719 | A1 * | 10/2020 | B66C 13/02 |

* cited by examiner

*Primary Examiner* — Michael R Mansen
*Assistant Examiner* — Juan J Campos, Jr.
(74) *Attorney, Agent, or Firm* — McCoy Russell LLP

(57) ABSTRACT

The present invention relates to a crane, in particular a deck crane, which comprises a boom which is erectable in its height about an axis of rotation, and an erecting trestle for deflecting a rope of a retracting mechanism in order to erect the boom. The invention is characterized in that the erecting trestle is erectable in its height, and the erecting trestle comprises a pull bar which includes a rotary joint in order to rotate a first portion of the pull bar with respect to a second portion of the pull bar.

16 Claims, 3 Drawing Sheets

CRANE WITH AN ERECTING TRESTLE

CROSS REFERENCE TO RELATED APPLICATION

The present application claims priority to German Patent Application No. 20 2019 106 512.5, entitled "KRAN MIT AUFRICHTBOCK", and filed on Nov. 22, 2019. The entire contents of the above-listed application is hereby incorporated by reference for all purposes.

TECHNICAL FIELD

The present invention relates to a crane with an erecting trestle, in particular a deck crane with an erecting trestle.

BACKGROUND AND SUMMARY

An erecting trestle, often also simply called an A-trestle, is an auxiliary device for erecting and holding a crane boom. Typically, the erecting trestle extends firmly from a crane base, on which the erectable boom is also pivotally arranged.

When the boom is in a deposited position, i.e. for example rests horizontally on a support device or the like, the overall height of the crane is significantly reduced so that the crane can pass underneath height-limiting obstacles. The maximum height of a crane set in this way is then determined by the height of the erecting trestle. A rope connected to the boom is passed over the same in order to erect the boom when the rope length is shortened.

As explained already, in a transit state or state in which the boom is lowered or deposited, the erecting trestle is by far the highest point on the crane. This applies in particular also on a ship on which such a crane is installed. This aspect leads to problems during the passage of the ship or any other vehicle on which the crane is installed, as the maximum height turns out to be problematic when passing under obstacles such as bridges, high-voltage power lines, and the like.

It is the objective of the present invention to provide a crane which solves or at least mitigates the problem described above in detail. This is accomplished with a crane which includes all features of claim 1. Further advantageous embodiments of the crane are set forth in the dependent claims.

Accordingly, the crane according to the invention, in particular a deck crane or another crane mounted on a vehicle, comprises a boom which is erectable in its height about an axis of rotation, and an erecting trestle for deflecting a rope of a retracting mechanism in order to erect the boom. The crane is characterized in that the erecting trestle is erectable in its height, and the erecting trestle preferably comprises a pull bar which includes a rotary joint to rotate a first portion of the pull bar with respect to a second portion of the pull bar.

Rotating the pull bar of the erecting trestle allows the erecting trestle to be folded in, so that the same can take up less space in its height extension. In a state in which the boom is deposited, the erecting trestle accordingly can also be folded down, so that then the overall height of the crane is further reduced.

This involves the advantage that now previously impassable height-limiting obstacles can also be passed, so that detours are no longer required. It is furthermore advantageous that a crane in which the erecting trestle can be folded or folded down (or also is erectable), has a lower center of gravity, which is advantageous for the vehicle, e.g. a ship.

The lowering of the overall height also leads to the effect that the wind attack area of the crane brought into its transport state is reduced, so that this also provides advantages for the transport of the crane on the vehicle carrying the crane.

According to a development of the invention it can be provided that the rotary joint of the pull bar can be locked in order to fix the erecting trestle in its erected position, wherein locking of the rotary joint preferably is effected via a hydraulic cylinder.

When the erecting trestle is in its erected position, locking of the rotary joint of the pull bar ensures that the same is of the rigid type. There can be used hydraulic cylinders which fix the portions of the pull bar movable relative to each other, so that erecting the boom can be performed in the usual way.

The rotary joint of the pull bar divides the linear course of the erecting trestle in its erected position into two portions movable relative to each other, which preferably are movable relative to each other about a kind of hinge joint. By pivoting the two portions relative to each other, the pull bar is folded and thereby reduced in its height.

When the boom is deposited, the erecting trestle is in its erected state and the rotary joint is unlocked, the crane according to an advantageous embodiment can be designed to lower the erecting trestle via an actuation of the retracting mechanism, wherein during lowering the erecting trestle preferably is supported on the inherent mass of the deposited boom.

By adding rope length, it is possible for the erecting trestle to pivot towards the ground in the direction opposite to the boom. The weight of the erecting trestle is held by the deposited boom, which can be lowered due to the foldable or pivotable pull bar.

It can be provided that the rotary joint of the pull bar is a hinge joint, wherein its axis of rotation preferably is parallel to the axis of rotation of the erectable boom.

According to the invention it can also be provided that the boom and the erecting trestle can be deposited in mutually opposite directions.

According to another modification, the crane furthermore comprises a crane base from which the boom and the erecting trestle extend and on which the retracting mechanism preferably is arranged.

The crane base hence is the starting point both for the boom and for the erecting trestle and includes corresponding joints in order to fasten both the boom and the erecting trestle to the crane base so as to be erectable.

Furthermore, it can be provided that at its distal end region the erecting trestle includes a deflection pulley for guiding a rope of the retracting mechanism.

By means of this deflection pulley a rope acting on the boom is deflected. When the rope length now is shortened with the erecting trestle fixed and set up, the boom is lifted.

On the other hand, when the erecting trestle is not yet set up, but deposited, a reduction of the rope length leads to an erection of the erecting trestle due to the lower weight of the erecting trestle as compared to the boom, until said erecting trestle has assumed its final, erected position. Thereafter, the rotary joint is locked so that the erecting trestle remains in its upright position regardless of the added rope length.

Furthermore, it can be provided that at its distal end region the boom includes a deflection pulley for guiding a rope of the retracting mechanism. Alternatively, however, there can also be provided a simple attachment of the rope to the boom.

On the other hand, when a deflection pulley is provided at the distal end region of the boom or boom element, the rope typically is guided back in the direction of the erecting trestle, where it is then fixed. This reduces the forces required for erecting the boom.

According to another optional development of the invention it can be provided that beside the pull bar the erecting trestle comprises a rigid rod-like element which is connected to the pull bar in the deflecting region of the rope of the retracting mechanism. If the pull bar were not of the foldable type, depositing of the erecting trestle could not take place. The rigid rod-like element can be pivoted at its end facing the crane base so that on "folding" of the pull bar the rod-like element can be folded down.

According to an advantageous embodiment of the invention it can therefore be provided that the boom, the rigid rod-like element and also the pull bar are each arranged on a crane base via an associated rotary joint, wherein preferably the axes of rotation of the rotary joints arranged on the crane base are arranged parallel to each other.

Furthermore, the axis of rotation of the rotary joint, which divides the pull bar into two portions rotatable relative to each other, can also be parallel to the axes of rotation of the other rotary joints.

In addition, the crane furthermore can be equipped with a storage winch for receiving a certain amount of rope length of the rope actuated by the retracting mechanism, wherein the storage winch preferably is arranged on the erecting trestle, in particular on the pull bar or the rigid rod-like element.

Accordingly, the additional rope length required for lowering the erecting trestle can first be transferred from the storage winch to the retracting winch in order to then lower the erecting trestle by actuating the retracting winch. The advantage of this implementation consists in that with an erected erecting trestle the retracting winch must wind up only so many rope layers as is required for the active crane operation. In turn, this has a positive influence on the winding behavior of the retracting winch, as in operation it has to move less of the rope not used.

Furthermore, the crane can be provided with a deposition point for supporting the deposited pull bar in its lowered position in order to relieve the retracting mechanism.

Accordingly, there is a stop point or a stop receptacle for supporting or receiving a portion of the pull bar in a state folded in. By putting down the erecting trestle, more exactly a part of the pull bar, the retracting mechanism can be relieved so that the lowered state of the erecting trestle can also be taken for extended periods.

According to another optional modification of the present invention it can be provided in addition that the rotary joint of the pull bar includes a mechanical stop in order to prevent the pull bar from being deposited in the direction of the boom.

According to the invention it can furthermore be provided that the erecting trestle, preferably the pull bar, in its completely erected position is directed slightly obliquely away from the boom to the rear in order to be folded down to the rear, i.e. away from the boom, when the rotary joint of the pull bar is unlocked.

Furthermore, according to an advantageous modification of the invention, it can be provided that depositing the erecting trestle is effected by gravity, wherein preferably the hydraulic cylinders present for locking the rotary joint support the deposition by a corresponding pretension.

In an advantageous embodiment, the invention likewise comprises a locking mechanism for the boom in a deposited or lowered position. It is advantageous here that on deposition of the erecting trestle the entire weight thereof not only is held by the inherent mass of the boom, but the locking mechanism provides the system with additional stability. Locking of the boom also provides for folding down an erecting trestle which would lift an unlocked boom due to its mass.

BRIEF DESCRIPTION OF THE FIGURES

Further features, details and advantages of the present invention will become apparent from the following description of Figures. In the drawing.

DETAILED DESCRIPTION

Figure 1:
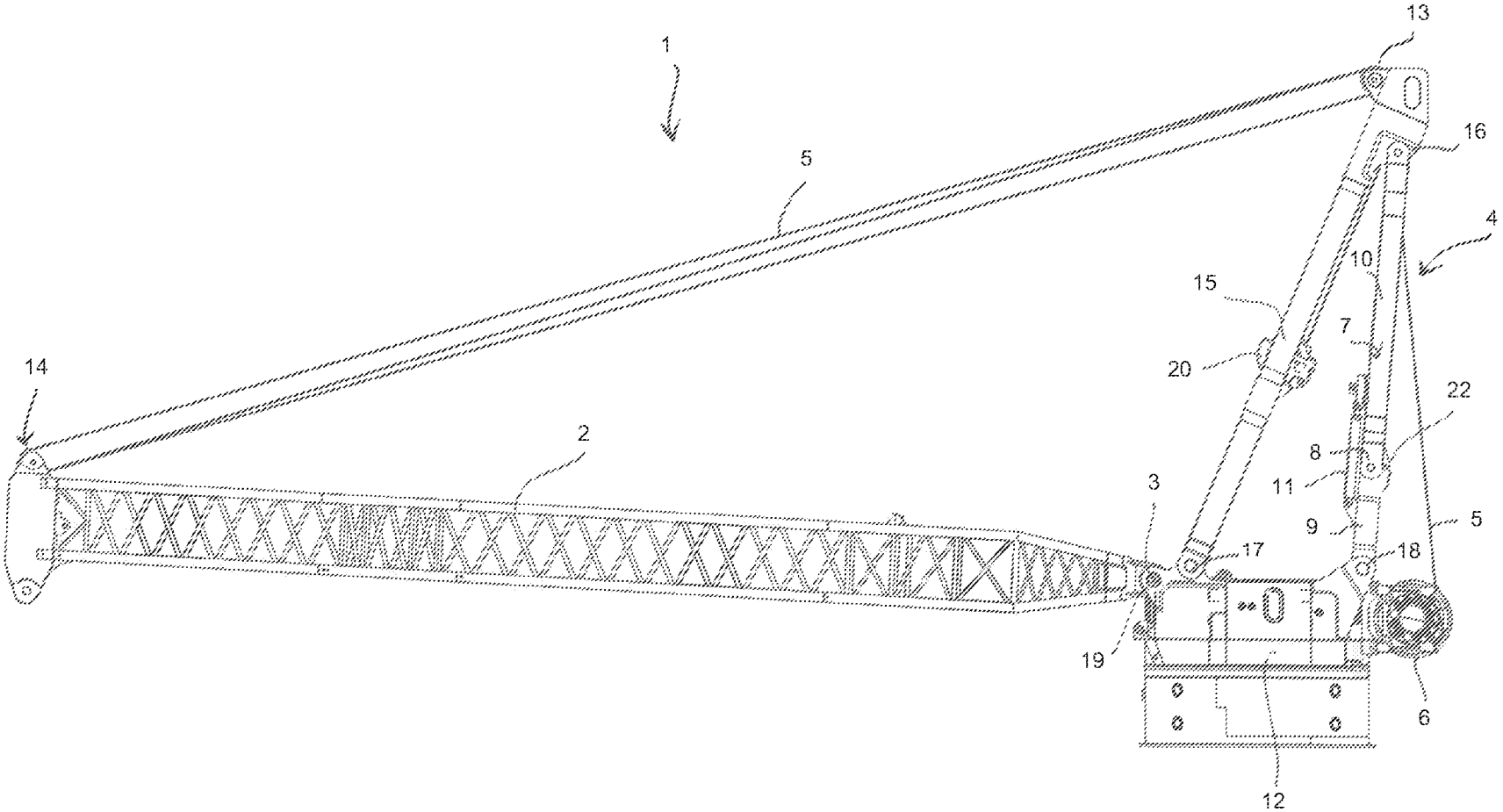
FIG. 1: shows a schematic basic construction of the crane according to the invention with an erected erecting trestle.

FIG. 1 shows a schematic view of the crane 1 according to the invention. From a crane base 12 a boom 2 extends, which in FIG. 1 is shown in the state already deposited or lowered. The boom 2 is coupled with the crane base 12 via a base rotary joint 19 so that the boom 2 can be pivoted on this base rotary joint 19. The pivot axis 3 extends substantially perpendicularly to the longitudinal extension of the boom 2. The boom 2 including a possible load suspended on the boom 2 is held via the retracting mechanism 6. The load radius (i.e. the outreach of the crane 1) can changed by actuating the retracting mechanism 6. The geometry of the erecting trestle 4 is chosen such that an optimum of system forces is obtained via favorable lever ratios.

At the end of the boom 2 remote from the crane base 12 a deflection pulley 14 is provided, which cooperates with a rope 5 extending obliquely upward therefrom. This rope 5 is guided over an erecting trestle 4 to a rope winch 5 (also: retracting mechanism) arranged on the crane base 12, so that with a rigid erecting trestle 4 a reduction of the rope length leads to an erection of the boom 2.

In the present case, the erecting trestle 4 comprises a pull bar 7 and an optional further rod-like element 15 which can be of rigid design. At the respective ends facing the crane base 12, both the pull bar 7 and the rod-like element 15 include a base rotary joint 17, 18 which provides for a pivotal movement. The axes of rotation of the base rotary joints 17, 18 and 19 are parallel in the present case, wherein this need not be the case in principle for the invention. At their ends remote from the crane base 12, the pull bar 7 and the rod-like element 15 are connected to each other via a rotary joint 16 in the form of a hinge joint. Furthermore, the pull bar 7 is arranged at a greater distance from the boom 2 than the rod-like element 15, i.e. is offset to the rear with respect to the rod-like element 15.

The pull bar 7 is not formed in one piece, but comprises two portions 9, 10 foldable relative to each other, which are movable or rotatable relative to each other via a rotary joint 8. Due to this rotary joint 8 it is possible to lower the erecting trestle 4 to the rear, i.e. away from the boom 2, in order to reduce the maximum height of the crane during a transport or the like.

The erecting trestle 4 can integrate the retracting mechanism 6 of the boom 2, by means of which the boom angle can be adjusted. The boom 2 including the load is held via the retracting mechanism 6, and the load radius (outreach) can be changed via the actuation of the retracting mechanism 6.

For depositing/folding the erecting trestle 4, the pull bar 7 has the additional rotary joint 8 by means of which two portions 9, 10 of the pull bar 7 can be rotated against each other. In crane operation, i.e. with an erected erecting trestle 4, this joint 8 is locked and ensures a straight alignment of the two portions 9, 10 constituting the pull bar 7. For depositing the erecting trestle 4, the joint 8 then is unlocked. Locking the joint is effected via one or more hydraulic cylinders 11. Folding the erecting trestle 4 chiefly or exclusively is effected via the retracting mechanism 6. As soon as the additional rotary joint 8 arranged in the pull bar 7 is unlocked, the entire mass of the erecting trestle 4 hangs only in the retracting mechanism 6. The retracting mechanism 6 is supported on the boom 2 or its inherent mass. Supporting can be effected by the boom weight or an additional boom lock (not shown). The position of the center of gravity of the erecting trestle 4 effects that the erecting trestle 4 is folded down to the rear. In the present case, the portion 9 of the pull bar 7 facing the crane base 12 rotates away from the boom in clockwise direction so that the tip area of the erecting trestle 4 facing away from the crane base 12 is lowered. With the aid of the hydraulic cylinders 11, which span the rotary joint 8, i.e. are arranged both on the one portion 9 and on the other portion 10 of the pull bar 7, this can contribute to the pull bar 7 being folded down in a controlled way.

The lower portion 9 in general is rotated downwards to the rear by an angle in the range from about 140° to 170°, until the portion 9 rests on a deposition point 21 of the crane base 12.

The lowering movement of the erecting trestle 4 in essence can be divided into two parts, wherein initially only the rotary joint 8 is transferred into an open position, which by simultaneously rotating the lower portion 9 downwards to the rear leads to lowering of the tip of the erecting trestle. In this phase, the upper portion 10 remains in about the same orientation, but of course follows in the shape of a circular arc which is specified by the rotation of the lower portion on the base rotary joint 18.

Figure 2:
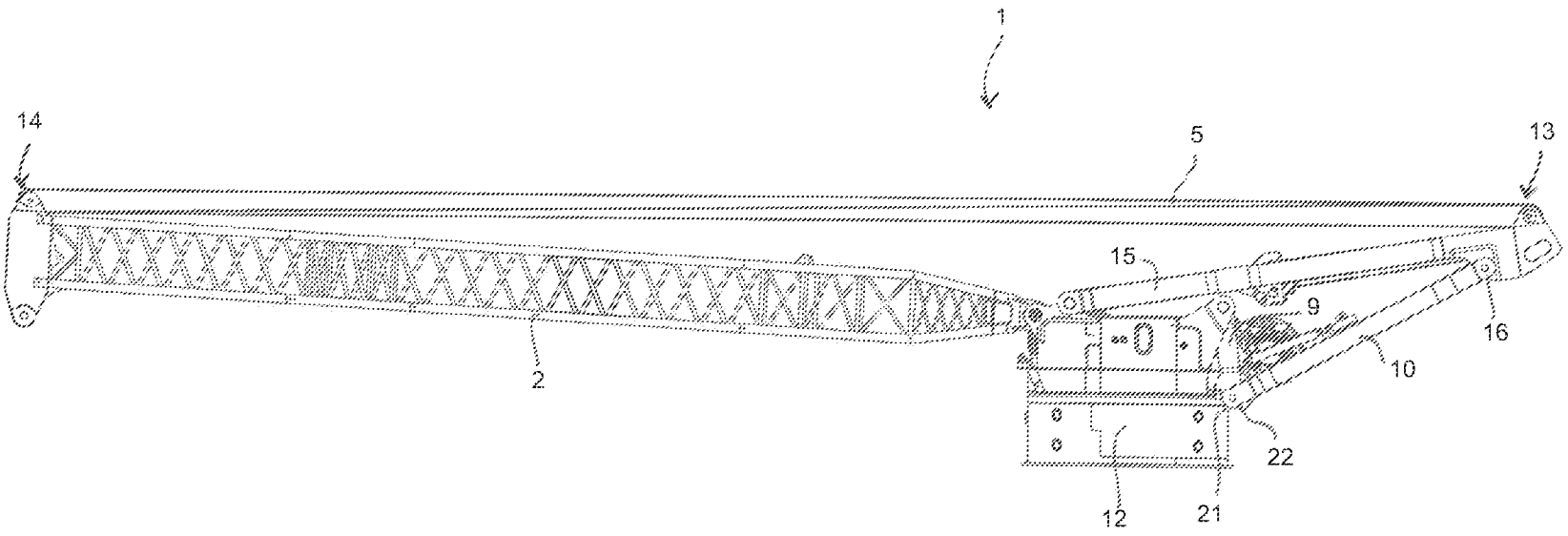
FIG. 2: shows a schematic basic construction of the crane according to the invention with a deposited erecting trestle.

When the rotary joint 8 is in its maximally open position (visible e.g. in FIG. 2), the entire arrangement of the two portions 9, 10 is rotated downwards to the rear about the base rotary joint 18 so that it ultimately reaches the position shown in FIG. 2.

This procedure can additionally be supported by hydraulic cylinders 11 in the form of a pretension. The hydraulic cylinders also can ensure that the pull bar 7 is specifically transferred into a lowering movement. A forward deflection of the pull bar 7 is prevented by a mechanical stop 22. Furthermore, a forward deflection is inhibited by the inherent weight of the erecting trestle 4, as its components are arranged in such a way that in an unlocked state and with the addition of rope length the same is folded down to the rear.

The depositing operation is limited by a shelf 21 (cf. FIG. 2) which receives the first portion 9 and/or the second portion 10 of the pull bar 7. The shelf can be designed such that even longer transits of the ship or of the vehicle accommodating the crane are possible. The retracting mechanism can be relieved, i.e. the retracting ropes are free of load.

Figure 3:
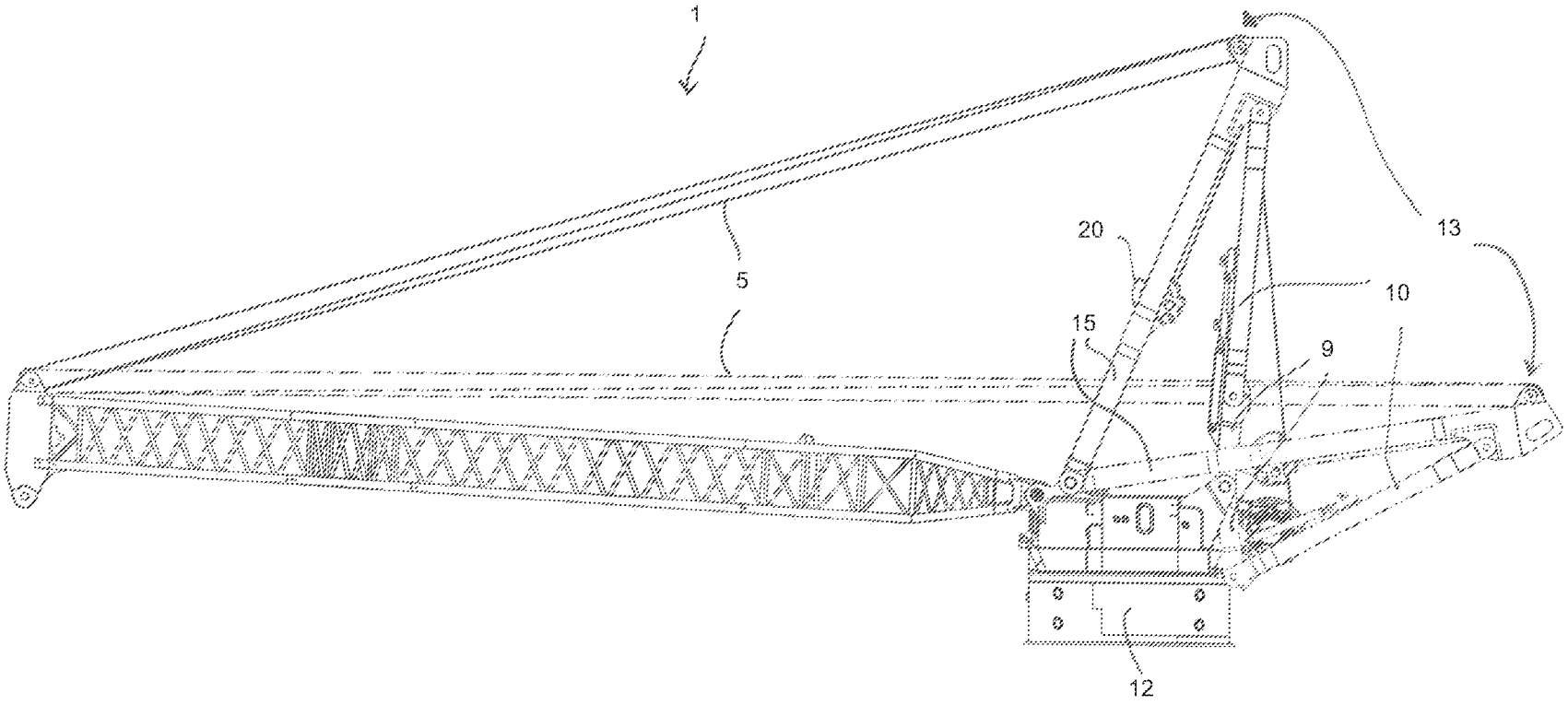
FIG. 3: shows a schematic basic construction of the crane according to the invention, which illustrates both the erected and the deposited erecting trestle in a joint representation.

FIG. 3 shows the two different positions of the erecting trestle 4 achievable by means of the invention, wherein in firm, continuous lines the regular working position of the erecting trestle 4 is shown, whereas the position of the erecting trestle 4 folded down or folded is shown with broken lines.

The height difference achievable with the invention is clearly visible so that the advantages possible therewith are easily comprehensible.

Due to the different geometrical conditions both in the erected and in the deposited state, the depositing operation requires a correspondingly longer rope 5 (or ropes in retracting mechanisms with double winches). With an erected erecting trestle, the additional rope length is stored either on the retracting winch 6 or, as shown, on an optional additional storage winch 20.

Hence, during the depositing operation it is possible to either unwind the required additional rope length directly from the retracting winch 6 or—when a storage winch 20 is present—initially transfer the required additional rope length from the storage winch 20 to the retracting winch 6 in order to then lower the erecting trestle 4 by actuating the retracting winch 6.

The advantage of this system consists in that with an erected erecting trestle 4 the retracting winch 6 must move only so much rope 5 as is required for the active crane operation, which in turn has a positive influence on the winding behavior of the retracting winch 6. In the regular working mode, the rope winch 6 accordingly does not have to rotate the rope length required for depositing the erecting trestle, so that the efficiency of the rope winch 6 is improved.

Only when actually considering to lower the erecting trestle 4, can some rope 5 be transferred from the storage winch 20 to the retracting winch 6 by a rope transfer operation. Without a change in position of any of the structural components of the crane 1, some rope 5 can be reeled off from the storage winch 20 at a certain speed and be wound up by the retracting winch 6 at the same speed.

It is clear to the skilled person that the erecting trestle 4 can include a plurality of pull bars 7 of the aforementioned type. Thus, the side view of FIGS. 1-3 does not exclude that there is at least one further pull bar 7 and/or at least one further rod-like element 15, which are arranged offset in the width direction of the crane 1 (i.e. perpendicularly to the longitudinal extension of the boom 2). The plurality of pull bars 7 and/or the plurality of rod-like elements 15 can be connected to each other at a common tip area of the erecting trestle 4, wherein the fundamental principle of folding down the erecting trestle 4 is not impaired, however.

LIST OF REFERENCE NUMERALS

1 crane
2 boom
3 axis of rotation of the boom
4 erecting trestle
5 rope of the retracting mechanism
6 retracting mechanism
7 pull bar
8 rotary joint of the pull bar
9 first portion of the pull bar
10 second portion of the insert
11 hydraulic cylinders
12 crane base
13 deflection pulley of the erecting trestle
14 deflection pulley of the boom
15 rigid rod-like element
16 rotary connecting joint
17 base rotary joint of the rigid rod-like element
18 base rotary joint of the pull bar

19 base rotary joint of the boom
20 storage winch
21 deposition point
22 stop

The invention claimed is:

1. A crane, comprising:

a boom which is vertically erectable about an axis of rotation, and an erecting trestle for deflecting a rope of a retracting mechanism in order to erect the boom, wherein the erecting trestle is vertically erectable, and the erecting trestle comprises a pull bar which includes a rotary joint spanned by hydraulic cylinders in order to rotate a first portion of the pull bar with respect to a second portion of the pull bar.

2. The crane according to claim 1, wherein the rotary joint of the pull bar can be locked in order to fix the erecting trestle in an erected position, wherein locking of the rotary joint is effected via a hydraulic cylinder.

3. The crane according to claim 1, wherein the crane is designed to lower the erecting trestle via an actuation of the retracting mechanism when the boom is deposited, the erecting trestle is erect and the rotary joint is unlocked, wherein during lowering the erecting trestle is supported on an inherent mass of the deposited boom and/or is lowered in a direction opposite to the boom.

4. The crane according to claim 3, wherein the rotary joint of the pull bar includes a mechanical stop in order to prevent the pull bar from being deposited in the direction of the boom.

5. The crane according to claim 1, wherein the rotary joint is a hinge joint, whose axis of rotation is parallel to the axis of rotation of the boom.

6. The crane according to claim 1, wherein the boom and the erecting trestle can be deposited in mutually opposite directions.

7. The crane according to claim 1, further comprising a crane base from which the boom and the erecting trestle extend and on which the retracting mechanism is arranged.

8. The crane according to claim 1, wherein a distal end region of the erecting trestle includes a deflection pulley for guiding the rope of the retracting mechanism.

9. The crane according to claim 1, wherein a distal end region of the boom includes a deflection pulley for guiding the rope of the retracting mechanism.

10. The crane according to claim 1, wherein beside the pull bar the erecting trestle comprises a rigid rod-like element which in a deflecting region of the rope of the retracting mechanism is connected to the pull bar via a connecting rotary joint.

11. The crane according to claim 10, wherein the boom, the rigid rod-like element, and the pull bar, are each arranged on a crane base via an associated base rotary joint, wherein axes of rotation of the base rotary joints arranged on the crane base are arranged parallel to each other.

12. The crane according to claim 11, wherein an axis of rotation of the rotary joint, which divides the pull bar into two portions rotatable relative to each other, is parallel to the axes of rotation of the base rotary joints.

13. The crane according to claim 10, further comprising a storage winch for receiving a certain amount of rope length of the rope actuated by the retracting mechanism, wherein the storage winch is arranged on the erecting trestle on the pull bar or the rigid rod-like element.

14. The crane according to claim 1, further comprising a deposition point for supporting the deposited pull bar in a deposited position in order to relieve the retracting mechanism.

15. The crane according to claim 14, wherein depositing of the erecting trestle is effected by gravity, wherein the hydraulic cylinders present for locking the rotary joint support the deposition by a corresponding pretension.

16. The crane according to claim 1, wherein when in a completely erected position, the erecting trestle is directed slightly obliquely away from the boom in order to be folded down away from the boom, when the rotary joint of the pull bar is unlocked.

* * * * *